US006451165B1

(12) United States Patent
Doelle et al.

(10) Patent No.: US 6,451,165 B1
(45) **Date of Patent: *Sep. 17, 2002**

(54) CHANNEL PULPER

(75) Inventors: Klaus Doelle, Menasha; Robert J. Matz, Appleton, both of WI (US)

(73) Assignee: Voith Paper, Inc., Appleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/710,752

(22) Filed: Nov. 9, 2000

(51) Int. Cl.[7] ..... D21C 7/06; D21C 7/08

(52) U.S. Cl. ..... 162/52; 162/246; 241/46.17; 366/76.91; 366/76.92

(58) Field of Search ..... 162/241, 248, 162/52, 246; 366/303, 407, 50, 76.91, 76.92, 35; 222/368; 241/43, 46.17, 79

(56) References Cited

U.S. PATENT DOCUMENTS

| | | | | | |
|---|---|---|---|---|---|
| 3,814,336 | A | * | 6/1974 | Brewer | 241/68 |
| 4,111,113 | A | * | 9/1978 | Lambert | 100/74 |
| 4,582,261 | A | * | 4/1986 | Perry | 241/21 |
| 4,663,045 | A | * | 5/1987 | Yeagley | 210/612 |
| 5,220,382 | A | * | 6/1993 | Hediger | 355/245 |
| 5,233,932 | A | * | 8/1993 | Robertson | 110/232 |
| 5,871,619 | A | * | 2/1999 | Finley et al. | 202/262 |
| 6,162,496 | A | * | 12/2000 | Blue | 427/212 |
| 6,267,847 | B1 | * | 7/2001 | Doelle et al. | 162/246 |

* cited by examiner

*Primary Examiner*—Dean T. Nguyen
(74) *Attorney, Agent, or Firm*—Taylor & Aust, P.C.

(57) ABSTRACT

A pulper in a stock preparation system includes a housing with a fiber inlet, at least one water inlet, at least one outlet and an inner chamber. A plurality of rotatable augers extend into the inner chamber.

47 Claims, 4 Drawing Sheets

CHANNEL PULPER

BACKGROUND OF THE INVENTION

1. Field of the Invention.

The present invention relates to a stock preparation system for preparing a fiber suspension for use in a papermaking machine, and, more particularly, to a pulper in such a stock preparation system.

2. Description of the Related Art

A fiber stock preparation system is used to make a fiber suspension from a source of fiber such as wood. The fiber stock preparation system receives the raw source of fiber, breaks the raw source of fiber into individual fibers suspended within a liquid such as water, and separates contaminants from the fiber suspension.

It is known to provide a pulper in a fiber stock preparation system as described above to break down the raw source of fiber into individual fibers. A pulper typically includes a rotatable element therein which imparts mechanical forces to the source of fiber and breaks the source of fiber into individual fibers. The pulped fiber is transported downstream to other mechanical devices within the stock preparation system. For example, the pulped fiber may be further processed within a disperger. A disperger receives the pulped fiber, removes contaminants from the fiber suspension and thoroughly mixes chemicals within the fiber suspension. The disperger includes a shaft assembly with a plurality of foils which move in very close proximity relative to a plurality of foils carried by a housing. The tight tolerances within the disperger are intended to process the liquid under relatively high pressure so that the chemicals may be thoroughly mixed and the contaminants removed. To achieve thorough mixing of the chemicals, the dwell time of the fiber suspension within the disperger is relatively long. The disperger has an output which is in the form of an open end of the housing which discharges directly to the ambient environment. Because of the tight tolerances and pressures utilized within the disperger, the consistency of the input source of fiber must be relatively low in order for the disperger to operate properly without clogging. That is, the input source of fiber must have a high percentage of water by weight in order for the disperger to operate properly. For this and other reasons, such a disperger has a low throughput rate.

What is needed in the art is a pulper which can pulp an input source of fiber with a relatively high input consistency, and at a high throughput rate.

SUMMARY OF THE INVENTION

The present invention provides a pulper in a stock preparation system with a plurality of individually controllable augers which extend into an inner chamber of a housing.

The invention comprises, in one form thereof, a pulper in a stock preparation system. The pulper includes a housing with a fiber inlet, at least one water inlet, at least one outlet and an inner chamber. A plurality of rotatable augers extend into the inner chamber.

An advantage of the present invention is that a pulper with a simplified construction and high throughput rate is provided.

Another advantage is that the pulper is capable of pulping an input source of fiber that has a relatively high consistency.

Yet another advantage is that each of the augers is individually controllable and reversible, thereby avoiding clogs and maximizing both the throughput rate and the consistency of input fiber that can be pulped.

A further advantage is that the pulper is capable of pulping larger pieces of an input source of fiber. Thus, no shredder is required for shredding bales of wastepaper.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
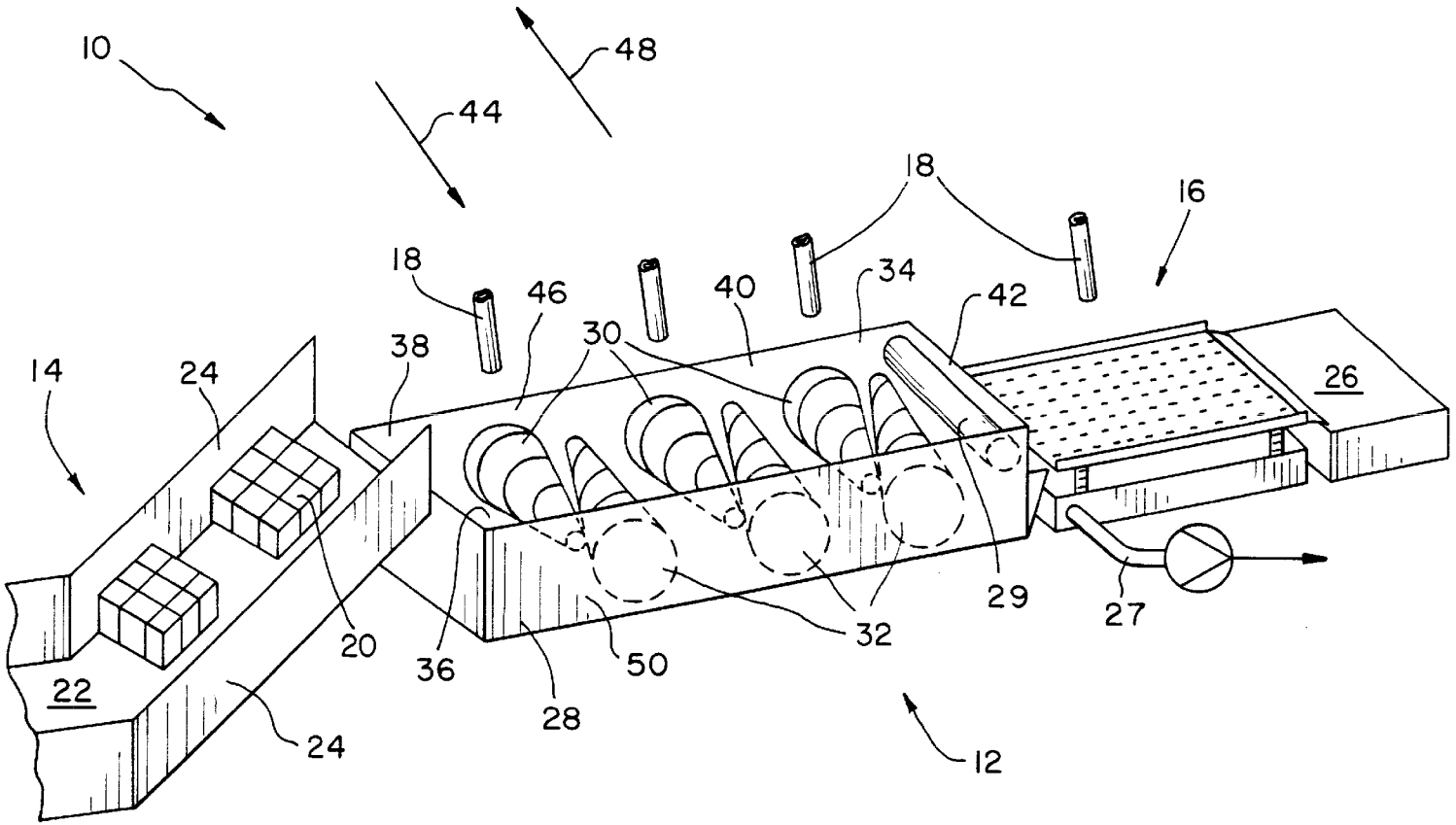
FIG. 1 is a schematic, perspective view of a stock preparation system including an embodiment of a pulper of the present invention.

Referring now to the drawings, and more particularly to FIG. 1, there is shown a stock preparation system 10 including an embodiment of a pulper 12 of the present invention, feed device 14, screen 16 and watering devices 18. If stock preparation system 10 is disposed in an exterior location, it may include an enclosure 19 (FIG. 2) covering pulper 12, feed device 14 and screen 16.

Feed device 14 provides an input source of fiber 20 such as wood fiber, pulp bales or recycled paper to pulper 12. In the embodiment shown, feed device 14 includes a conveyor 22 flanked by walls 24. Conveyor 22 receives the input source of fiber such as a bale 20 of recycled paper or cardboard and drops the input source of fiber into pulper 12 for disintegration therein.

Although feed device 14 is shown in the form of a conveyor 22 and walls 24 in the embodiment of FIG. 1, it is also possible for feed device 14 to be configured differently as part of stock preparation system 10 for providing an input source of fiber to pulper 12. For example, feed device 14 may be in the form of a sedimentation tank (not shown) with an outlet from which an input source of fiber is discharged to pulper 12.

Figure 3:
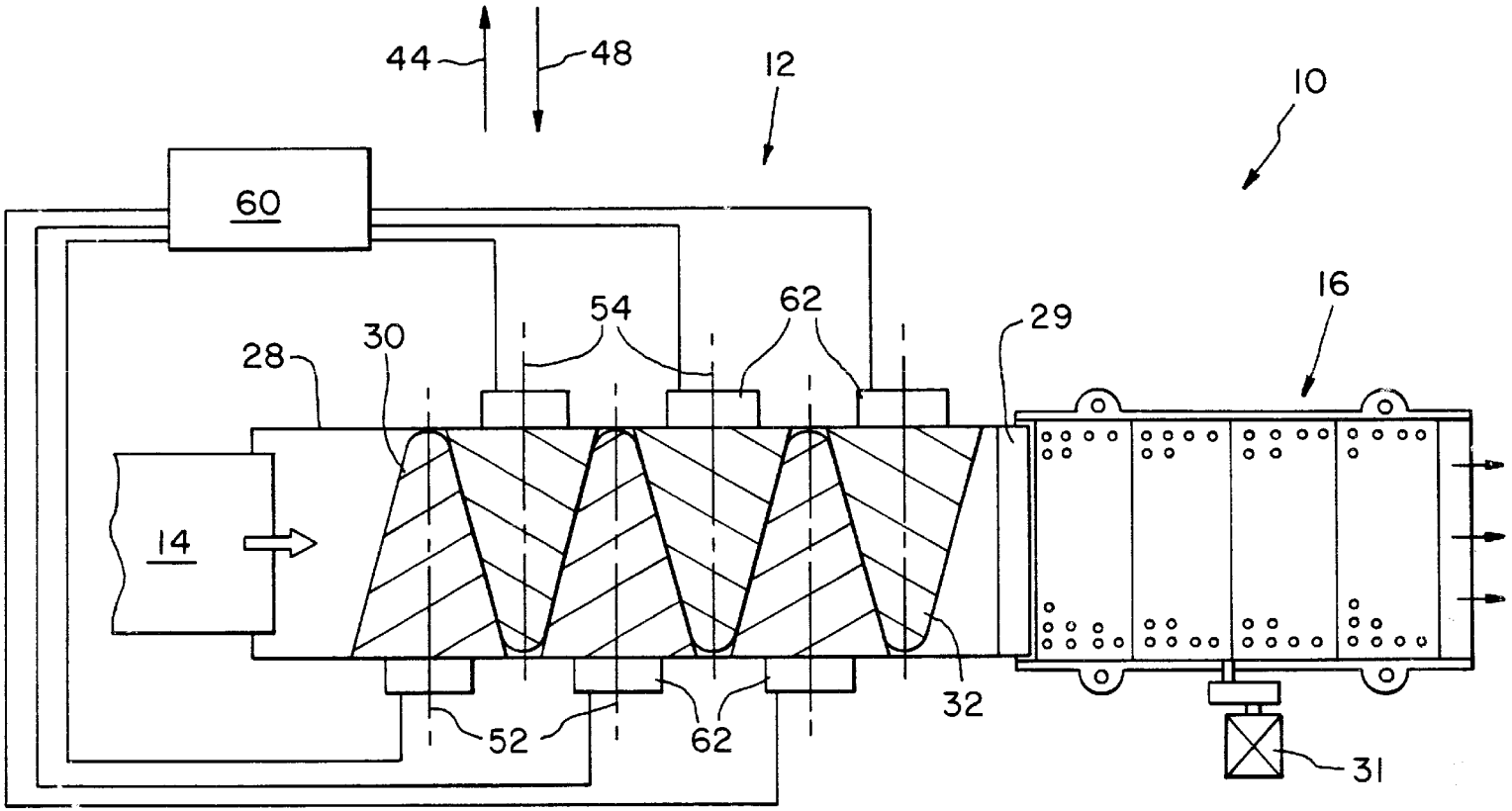
FIG. 3 is a schematic, sectional, bottom view of the stock preparation system of FIG. 1.

Screen 16 receives the pulped input source of fiber from pulper 12 and further processes the pulped input source of fiber into a fiber suspension which is utilized by a papermaking machine. In the embodiment shown, screen 16 is in the form of a vibration screen used to separate foreign particles from the pulped input source of fiber. Screen 16 sorts out contaminants having an area of approximately one square inch or larger. The reject is dumped into a dumpster box 26 for further processing or disposal. The usable fibers are fed through line 27 for further processing. Vibration screen 16 is powered by a drive unit 31 (FIG. 3).

Watering devices 18 spray water into pulper 12 and onto screen 16. That is, at least one water spray device 18 is associated with screen 16, and at least one water spray device 18 is associated with pulper 12. The water mixes with bales 20 in pulper 12 in order to facilitate pulping. The mixture has a consistency approximately between 15% and 40% when output from housing 28. That is, bales 20 provide approximately between 15% and 40% of the weight of the mixture of bales 20 and water. The mixture can possibly have an output consistency approximately between 20% and 30%. Water from a watering device 18 also rinses usable pulp fibers from contaminants on screen 16.

Pulper 12 generally includes a housing 28, a discharge roll 29, and a plurality of augers 30, 32. Housing 28 is in the form of a concrete or steel tank having an open top 34 providing access to an inner chamber 36 which forms a channel along the length of housing 28. Open top 34 also provides housing 28 with a fiber inlet 38, a water inlet 40, and an outlet 42. Water inlet 40 is in fluid communication with at least one water sprayer 18.

Rotatable augers 30, 32 extend into inner chamber 36 in a cantilevered fashion, and are spaced apart at predetermined intervals along a length of housing 28. First augers 30 extend in a first horizontal direction 44 from a first side 46 of housing 28. Second augers 32 extend in a second horizontal direction 48, opposite from first horizontal direction 44, from a second side 50 of housing 28. Each first auger 30 is closely adjacent to at least one second auger 32 to thereby enable effective pulping therebetween. Augers 30, 32 have respective rotational axes 52, 54 that are parallel to and coplanar with each other in a horizontal plane. A gap 56 between augers 30, 32 and a bottom side 58 of housing 28 is approximately between three and six inches. Augers 30, 32 may either be separate from and attached to housing 24, or may be integrally formed with housing 24.

Each of augers 30, 32 can be individually driven and controlled by a common, centralized hydraulic power unit 60 via respective drives 62. Each of augers 30, 32 is rotatable in either of the rotational directions indicated by double arrow 63. Power unit 60, which includes an electrical processor, can individually control the rotational speed, rotational direction and/or torque exerted on each of augers 30, 32 in order to achieve good mixing and forward movement of the pulp. Drives 62 can each include either a hydraulic motor or an electric motor.

In use, the rotation of augers 30, 32 mixes the water and input source of fiber into a pulp slurry. As the high consistency pulp slurry proceeds along the length of housing 28, the pulp slurry is discharged from housing 28 by the rotation of discharge roll 29. The pulp slurry is retained in housing 28 for approximately between five minutes and twenty minutes, and possibly approximately between ten minutes and fifteen minutes. If the torque exerted on one of augers 30, 32 exceeds a predetermined level, perhaps because of a clog, power unit 60 causes a reversal of the rotational direction of that auger, thereby alleviating the clog.

In contrast with a conventional disperger used in a stock preparation system, pulper 12 of the present invention provides a very high throughput rate with a high level of input consistency. A disperger includes a shaft assembly with an auger and movable pulping foils which move relative to stationary pulping foils within a housing. However, the purpose of a disperger is entirely different than that of a pulper and accordingly the configuration of the various components within a disperger is entirely different than pulper 12 of the present invention. For example, a disperger is typically utilized to remove small contaminants (such as dirt specs, stickies and coating particles) from the fiber suspension or to thoroughly mix chemicals added to the fiber suspension. Because of this functionality, the various tolerances between the moving parts within a disperger are kept at a very small distance, the throughput rate is very low and the input consistency must be relatively low. More particularly, a disperger of conventional design receives an inlet fiber stock at a consistency of between 25 to 35%.

In contrast, pulper 12 of the present invention receives an input source of fiber at a consistency of between 80 and 100% and provides a pulped output source of fiber at a consistency of between 15 and 40%. That is, pulper 12 receives an input source of fiber with little or no water added thereto at fiber inlet 38. Augers 30, 32 are structured and arranged relative to each other to receive the dry input source of fiber and still adequately pulp the fiber for use by a paper-making machine. A disperger of conventional design cannot be utilized to pulp an essentially dry input source of fiber.

Figure 2:
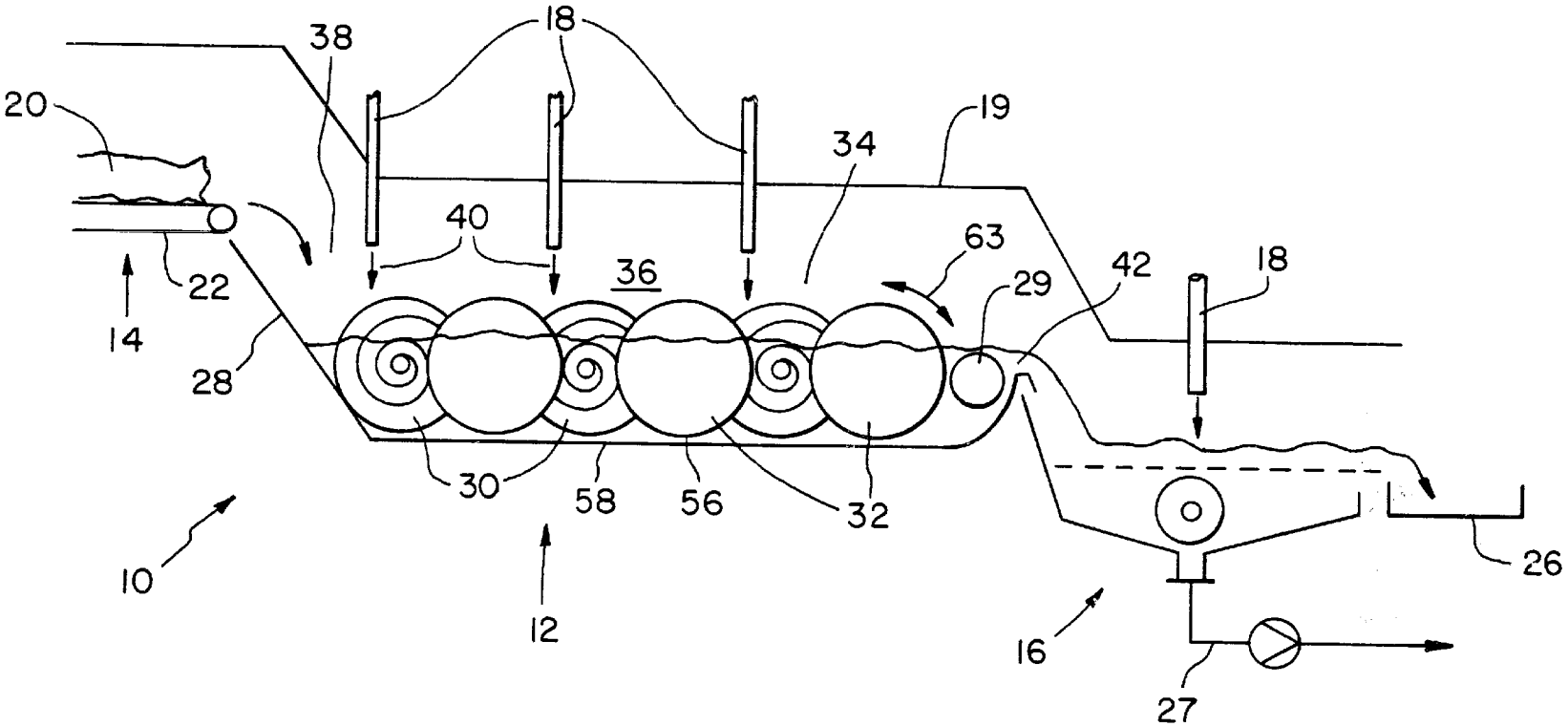
FIG. 2 is a schematic, side, sectional view of the stock preparation system of FIG. 1.
Figure 4:
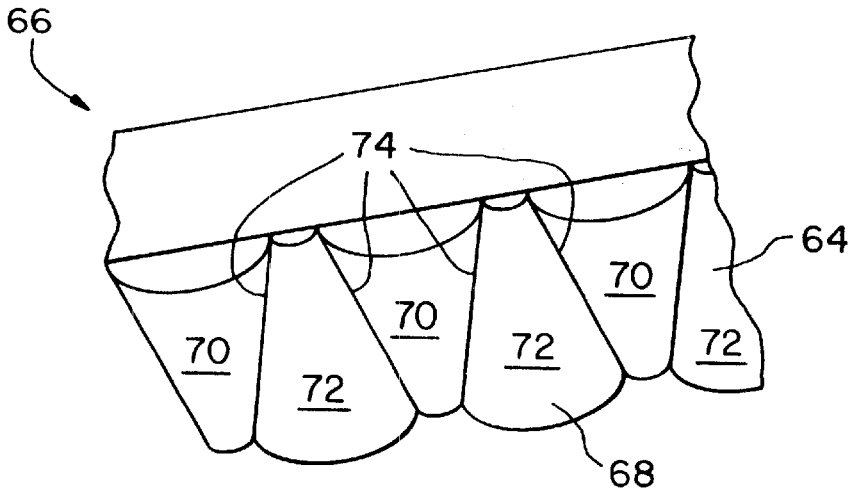
FIG. 4 is a fragmentary, sectional, perspective view of another embodiment of a tank of a pulper of the present invention.
Figure 5:
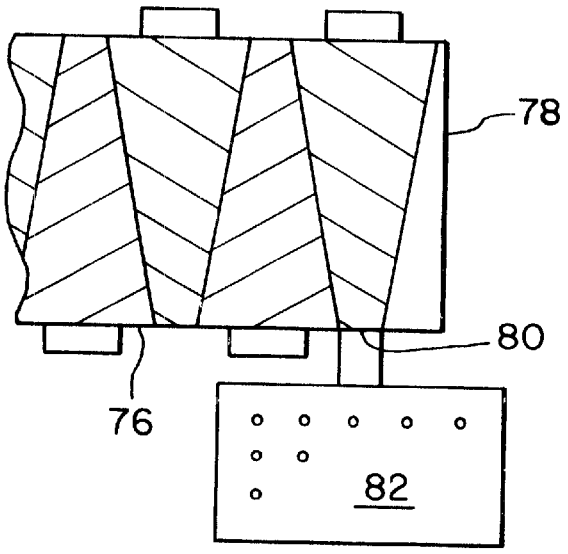
FIG. 5 is a fragmentary, schematic, bottom view of another embodiment of a detrashing device of a stock preparation system of the present invention.

Bottom side 58 of housing 28 is shown in the embodiment of FIGS. 1–3 as having a substantially flat or planar top surface. In another embodiment (FIG. 4), a bottom side 64 of housing 66 has an undulating top surface 68. More particularly, top surface 68 has a conical wave shape with a plurality of curved sections 70, 72. Each curved section 70, 72 conforms to a portion of an outer surface of a respective one of augers 30, 32. For example, the surface of a curved section 70 follows along and is equidistant from the rotational path of the periphery of an associated auger 30. That is, every point on curved section 70 may be distanced approximately between three and six inches from the rotational path of the periphery of the associated auger 30. Likewise, every point on a curved section 72 may be distanced approximately between three and six inches from the rotational path of the periphery of an associated auger 32. Peaks 74 formed between sections 70, 72 prevent pulp from accumulating in areas between augers 30, 32 where neither auger can reach the pulp.

In another embodiment (not shown), the top surface of the bottom side of the housing is provided with a series of ribs. Such ribs may extend parallel to the rotational axes of augers 30, 32.

Pulper 12 is shown in FIGS. 1–3 as using a discharge roll 29 to discharge the pulped input source of fiber to a screen 16. In another embodiment (FIG. 5), a side wall 76 of housing 78 includes a discharge port 80 through which the pulped slurry is discharged to a screen drum 82 for further processing the pulped input source of fiber. It is possible to direct water through discharge port 80 in order to facilitate the discharge of pulp slurry therethrough. Discharge port 80 may be plugged in order to prevent the contents of housing 78 from being discharged before they are properly pulped. It is also possible to discharge the pulped input source of fiber to another type of device within stock preparation system 10 for further processing of the pulped input source of fiber into a fiber suspension useable by a paper-making machine. Augers 30, 32 are shown in the embodiments of FIGS. 1–5 as being conical screw type augers having a continuous series of between one and six spiraling flights.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A stock preparation system, comprising:

a pulper including:

a housing with a fiber inlet, at least one water inlet, at least one outlet and an inner chamber; and a plurality of rotatable augers extending into said inner chamber.

2. The stock preparation system of claim 1, wherein each said auger has a respective rotational axis, at least two of said axes being substantially parallel.

3. The stock preparation system of claim 2, wherein all of said axes are substantially parallel.

4. The stock preparation system of claim 3, wherein all of said axes are substantially coplanar.

5. The stock preparation system of claim 3, wherein all of said axes are substantially horizontal.

6. The stock preparation system of claim 1, wherein said pulper is configured to provide a pulped output source of fiber at a consistency of between 15 and 40%.

7. The stock preparation system of claim 1, wherein at least one said auger comprises a conical screw auger having between one and six flights.

8. The stock preparation system of claim 7, wherein at least one said auger comprises a helical screw auger having between one and six flights.

9. The stock preparation system of claim 1, wherein said plurality of augers includes at least one first auger and at least one second auger, said at least one first auger extending into said inner chamber in a first direction, said at least one second auger extending into said inner chamber in a second direction substantially opposite to the first direction.

10. The stock preparation system of claim 9, wherein each said first auger is closely adjacent to at least one said second auger.

11. The stock preparation system of claim 1, further comprising a plurality of drive mechanisms, each said drive mechanism being connected with a respective said auger.

12. The stock preparation system of claim 11, wherein at least one said drive mechanism is configured to apply a variable level of torque upon said respective auger.

13. The stock preparation system of claim 12, wherein each said drive mechanism is configured to reverse a direction of rotation of said respective auger if the torque applied to said respective auger exceeds a predetermined level.

14. The stock preparation system of claim 11, wherein at least one said auger is driven with at least one of an individually controllable speed and an individually controllable torque.

15. The stock preparation system of claim 1, wherein said housing includes a bottom side having an undulating top surface.

16. The stock preparation system of claim 15, wherein each said auger has an outer surface, said undulating top surface of said bottom side of said housing having at least one curved section substantially conforming to a portion of said outer surface of a respective said auger.

17. The stock preparation system of claim 1, wherein said housing comprises a tank with an open top.

18. The stock preparation system of claim 1, further comprising a discharge device configured for discharging a pulped output source of fiber from said housing.

19. The stock preparation system of claim 18, wherein said discharge device comprises a discharge roller.

20. The stock preparation system of claim 1, further comprising at least one water sprayer in fluid communication with said at least one water inlet.

21. The stock preparation system of claim 1, further comprising a feed device having an outlet positioned in association with said fiber inlet, said feed device comprising a conveyor.

22. The stock preparation system of claim 1, further comprising a screen positioned relative to and downstream from each said outlet.

23. The stock preparation system of claim 22, wherein said screen comprises one of a vibration screen and a screen drum.

24. A pulper in a stock preparation system, comprising:

a housing with a fiber inlet, at least one water inlet, at least one outlet and an inner chamber; and a plurality of rotatable augers extending into said inner chamber.

25. The pulper of claim 24, wherein each said auger has a respective rotational axis, at least two of said axes being substantially parallel.

26. The pulper of claim 25, wherein all of said axes are substantially parallel.

27. The pulper of claim 26, wherein all of said axes are substantially coplanar.

28. The pulper of claim 26, wherein all of said axes are substantially horizontal.

29. The pulper of claim 24, wherein said pulper is configured to provide a pulped output source of fiber at a consistency of between 15 and 40%.

30. The pulper of claim 24, wherein at least one said auger comprises a conical screw auger having between one and six flights.

31. The pulper of claim 24, wherein at least one said auger comprises a helical screw auger having between one and six flights.

32. The pulper of claim 24, wherein said plurality of augers includes at least one first auger and at least one second auger, said at least one first auger extending into said inner chamber in a first direction, said at least one second auger extending into said inner chamber in a second direction substantially opposite to the first direction.

33. The pulper of claim 32, wherein each said first auger is closely adjacent to at least one said second auger.

34. The pulper of claim 24, further comprising a plurality of drive mechanisms, each said drive mechanism being connected with a respective said auger.

35. The pulper of claim 34, wherein at least one said drive mechanism is configured to apply a variable level of torque upon said respective auger.

36. The pulper of claim 35, wherein each said drive mechanism is configured to reverse a direction of rotation of said respective auger if the torque applied to said respective auger exceeds a predetermined level.

37. The pulper of claim 34, wherein at least one said auger is driven with at least one of an individually controllable speed and an individually controllable torque.

38. The pulper of claim 24, wherein said housing includes a bottom side having an undulating top surface.

39. The pulper of claim 38, wherein each said auger has an outer surface, said undulating top surface of said bottom side of said housing having at least one curved section substantially conforming to a portion of said outer surface of a respective said auger.

40. The pulper of claim 24, wherein said housing comprises a tank with an open top.

41. The pulper of claim 24, further comprising a discharge device configured for discharging a pulped output source of fiber from said housing.

42. The pulper of claim 41, wherein said discharge device comprises a discharge roller.

43. The pulper of claim 24, further comprising at least one water sprayer in fluid communication with said at least one water inlet.

44. The pulper of claim 24, further comprising a feed device having an outlet positioned in association with said fiber inlet, said feed device comprising a conveyor.

45. The pulper of claim 24, further comprising a screen positioned relative to and downstream from each said outlet.

46. The pulper of claim 45, wherein said screen comprises one of a vibration screen and a screen drum.

47. The pulper of claim 24, wherein a gap between a bottom side of said housing and at least one of said augers is approximately between three and six inches.

* * * * *